US006671470B2

(12) United States Patent
Suzuki et al.

(10) Patent No.: US 6,671,470 B2
(45) Date of Patent: Dec. 30, 2003

(54) IMAGE HEATING APPARATUS THAT CHANGES HEAT CONTROL AMOUNTS AT DIFFERENT MOVING SPEEDS

(75) Inventors: Masahiro Suzuki, Shizuoka (JP); Akihiko Takeuchi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/996,740

(22) Filed: Nov. 30, 2001

(65) Prior Publication Data

US 2002/0106211 A1 Aug. 8, 2002

(30) Foreign Application Priority Data

Dec. 1, 2000 (JP) ..... 2000-367253

(51) Int. Cl.[7] ..... G03G 15/20
(52) U.S. Cl. ..... 399/69; 399/328
(58) Field of Search ..... 399/67, 69, 68, 399/329, 328

(56) References Cited

U.S. PATENT DOCUMENTS

| | | | | |
|---|---|---|---|---|
| 4,068,089 A | | 1/1978 | Kuhnlein et al. | 380/52 |
| 4,723,129 A | | 2/1988 | Endo et al. | |
| 5,170,215 A | * | 12/1992 | Pfeuffer | 399/68 |
| 5,747,774 A | | 5/1998 | Suzuki et al. | 219/216 |
| 6,108,500 A | * | 8/2000 | Ohkama et al. | 399/67 |
| 6,314,252 B1 | * | 11/2001 | Matsumoto | 399/68 |
| 6,321,047 B1 | * | 11/2001 | Takata | 399/69 |
| 6,381,422 B1 | * | 4/2002 | Tanaka | 399/68 |

FOREIGN PATENT DOCUMENTS

| | | | |
|---|---|---|---|
| EP | 0 982 136 A2 | | 3/2000 |
| JP | 51-109737 | | 4/1976 |
| JP | 9-22206 | | 1/1997 |
| JP | 11-190956 | * | 7/1999 |
| JP | 2000-321895 | * | 11/2000 |

* cited by examiner

*Primary Examiner*—Susan S. Y. Lee
(74) *Attorney, Agent, or Firm*—Fitzpatrick, Cella, Harper & Scinto

(57) ABSTRACT

An object of the present invention is to provide an image heating apparatus that has heating device for heating an image formed on a recording material, the heating device including a moving member moving as coming into contact with the recording material, a temperature detecting element for detecting a temperature of the heating device, and power supply control device for controlling an electrical power to the heating device so that the temperature detected by the temperature detecting element is maintained at a set temperature, wherein the power supply control device sets the electrical power in accordance with the temperature detected by the temperature detecting element and a moving speed of the moving member.

20 Claims, 9 Drawing Sheets

FIXING SPEED 100mm/sec

FIXING SPEED 25mm/sec
(CONVENTIONAL EXAMPLE)

FIXING SPEED 25mm/sec
(EMBODIMENT)

IMAGE HEATING APPARATUS THAT CHANGES HEAT CONTROL AMOUNTS AT DIFFERENT MOVING SPEEDS

BACKGROUND OF THE INVENTION

1. Field of the Invention

The present invention relates to an image heating apparatus such as a heat fixing device equipped on an image forming apparatus such as a copying machine, a printer or the like, or an apparatus for improving a surface characteristic of an image, or the like.

2. Related Art

As a heat fixing device equipped on an image forming apparatus, a heat roller system which contains therein a halogen heater, a film heating system which fixes an image by passing via a heat-resistant film a sheet in a nip formed by a ceramic heater and a pressurizing roller, an induction heating system which generates heat by causing a rotator having a metallic layer to generate an eddy current, and the like have been put to practical use or devised.

In any system, direct or indirect targets of control (i.e., a heat roller in the heat roller system, the ceramic heater in the film heating system, and a metallic roller or a metallic film in the induction heating system are controlled to maintain target temperature. If controlling the target of control to maintain the target temperature, an actual temperature of this target rises and falls around the target temperature (i.e., a temperature ripple appears). It is desirable that the temperature ripple is small to secure excellent fixation of the image. Thus, PID (Proportional, Integral and Derivative) control including PI control and PD control as disclosed in U.S. Pat. No. 5,747,774 is generally used as a control method of decreasing the temperature ripple. In the PID control, on the basis of the trend of increase and decrease of a deviation between a detected temperature and a target temperature, the control is performed by not only making an operating amount of a power control means proportional to the deviation but also adding in the factor proportional to integration of the deviation and the factor proportional to differential of the deviation. Temperature information from a temperature detecting element is sampled at a certain period (sampling period) and included in the control rule.

Incidentally, to improve gloss (a gloss level) of the fixed image and improve transparentness of the fixed image on an OHP (Overhead Projector) film, the fixing is performed generally by decelerating a fixing speed more than a usual time. Also, when a recording material such as a thick sheet so that a large amount of heat is necessary for the fixing the fixing is performed by decelerating a fixing speed more than the usual time. Thus, it is necessary to change the fixing speed according to the target of a fixing process.

However, when the temperature is controlled by the PID control, there is a drawback that the control becomes unstable if the fixing speed changes.

That is, for example, on the metallic film used in the induction heating system, the eddy current is generated in an area where magnetic flux generated by a coil acts, whereby the temperature rises. However, if the fixing speed changes, the time required so that the metallic film passes the magnetic flux action area changes according to such a change, whereby also a calorific value (or heat value) of the film changes. For example, if the fixing speed is set to be ½, the magnetic flux supplied to a certain part on the film by the magnetic flux action area doubles. Therefore, if the fixing speed slows down, a temperature rise speed increases even if a power turning-on amount is the same.

That is, in case of a print mode in which the fixing speed slows down and the temperature rise speed thus increases, a temperature change of the target of control for the same operating amount is large as compared with a case where the fixing speed is fast.

Although the above PID control is effective at the specific fixing speed to suppress the temperature ripple of the target of control, a time factor is necessary, from the nature of control, for both the factor proportional to the integration of the deviation and the factor proportional to the differential of the deviation, whereby it takes a time until the temperature of the target of control settles into the target temperature because it is impossible to correspond sufficiently to a feedback speed required in the print mode in which the fixing speed is slow.

As a result, a problem that uniform gloss of the image on the surface of the recording material and/or uniform transparentness of the image on the OHP film can not be obtained is caused by the ripple (or vibration) of film temperature. Further, if the film temperature comes off from a fixable temperature area including the target temperature, a problem that defective fixing such as hot offset or cold offset arises is caused.

SUMMARY OF THE INVENTION

The present invention has been made in consideration of the above problems, and an object thereof is to provide an image heating apparatus which can secure stable fixation irrespective of a moving speed of a moving member of a heating means.

Another object of the present invention is to provide an image heating apparatus which can prevent toner offset and irregular optical transparentness of an OHP film irrespective of a fixing speed.

Still another object of the present invention is to provide an image heating apparatus comprising:

- a heating means for heating an image formed on a recording material, the heating means including a moving member moving as coming into contact with the recording material;
- a temperature detecting element for detecting a temperature of the heating means; and
- a power supply control means for controlling an electrical power to the heating means so that the temperature detected by the temperature detecting element is maintained at a set temperature,
- wherein the power supply control means sets the electrical power in accordance with the temperature detected by the temperature detecting element and a moving speed of the moving member.

Still another object of the present invention is to provide an image heating apparatus comprising:

- a heating means for heating an image formed on a recording material, the heating means including a moving member moving as coming into contact with the recording material;
- a temperature detecting element for detecting a temperature of the heating means; and
- a power supply control means for controlling an electrical power to the heating means so that the temperature detected by the temperature detecting element is maintained at a set temperature,
- wherein the power supply control means sets a sampling period of the output of the temperature detecting element in accordance with a moving speed of the moving member.

Still another object of the present invention is to provide an image heating apparatus comprising:

a heating means for heating an image formed on a recording material, the heating means including a moving member moving as coming into contact with the recording material;

a temperature detecting element for detecting a temperature of the heating means; and a power supply control means for controlling an electrical power to the heating means so that the temperature detected by the temperature detecting element is maintained at a set temperature, wherein the moving member can move at a first speed and a second speed lower than the first speed, and wherein if the electrical power to be supplied to the heating means is given as A when the moving speed of the moving member is the first speed, the set temperature is given as T1, and the detected temperature of the temperature detecting element is given as T, and if the electrical power to be supplied to the heating means is given as B when the moving speed of the moving member is the second speed, the set temperature is given as T1, and the detected temperature of the temperature detecting element is given as T, B<A is satisfied.

Further objects of the present invention will be apparent by reading the following description taken in conjunction with the accompanying drawings.

DETAILED DESCRIPTION OF THE PREFERRED EMBODIMENTS

Hereinafter, a fixing apparatus and an image forming apparatus according to the present invention will further be explained in detail according to the accompanying drawings.

Embodiment 1

Figure 1:
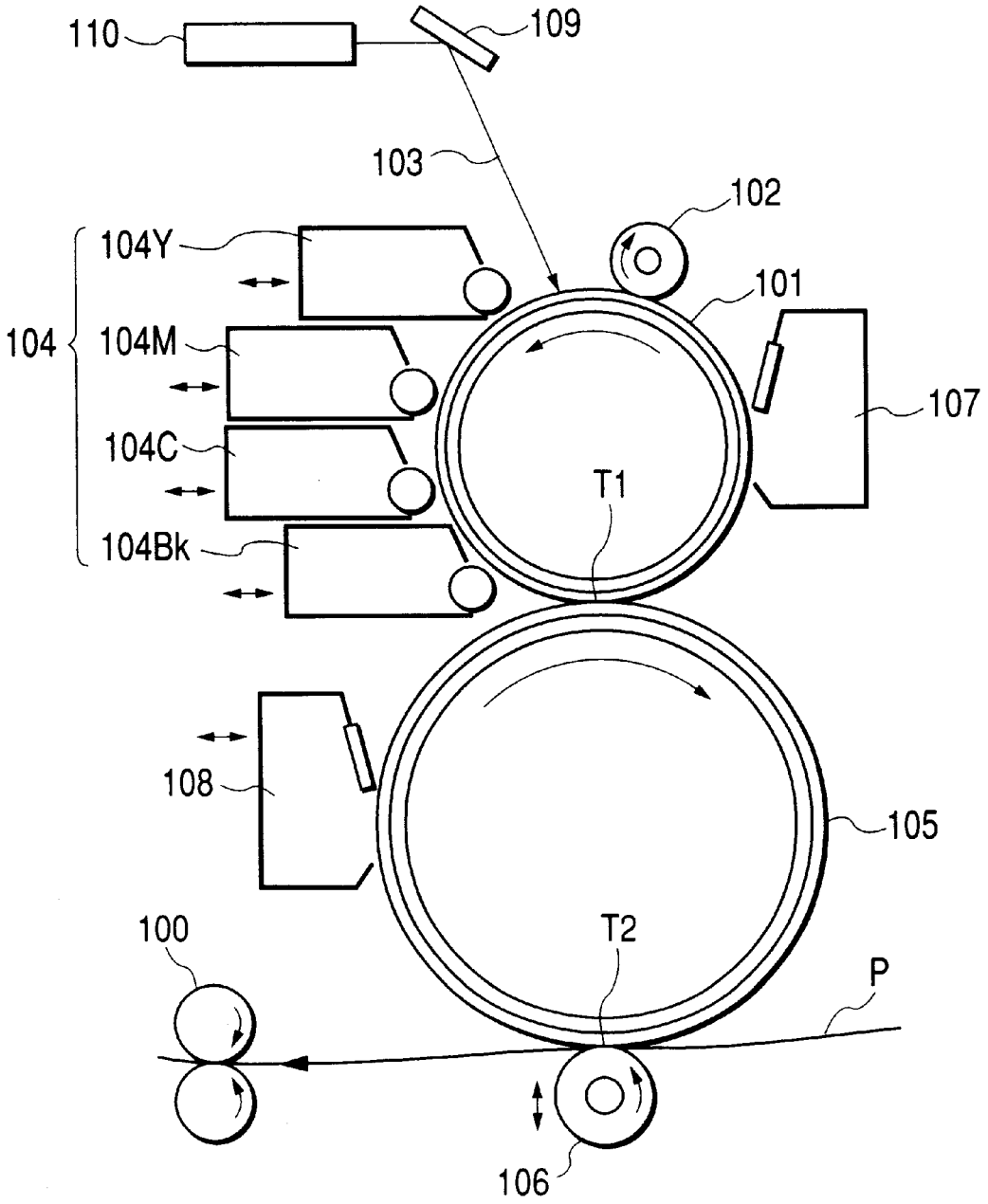
FIG. 1 is a schematic structural view showing an embodiment of an image forming apparatus according to the present invention.

FIG. 1 is a schematic structural view showing an embodiment of the image forming apparatus according to the present invention. Here, the image forming apparatus has been structured as an electrophotographic color laser beam printer.

A great feature of the present invention is to prevent irregular gloss on a fixed image, defective fixing, and irregular transparentness of a fixed image on an OHP film, by stably controlling a temperature of a heating member of a fixing apparatus 100 of film heating system equipped on the image forming apparatus to be maintained at a target temperature even if a fixing speed changes. First, the schematic structure of the image forming apparatus will be explained with reference to FIG. 1.

As shown in FIG. 1, the image forming apparatus includes a drum-type electrophotographic photosensitive body, i.e., a photosensitive drum 101, as an image bearing body. The photosensitive drum 101 is formed with an organic photosensitive body or an amorphous silicon photosensitive body, and rotatively driven counterclockwise as indicated by the arrow at a predetermined circular speed (same as a conveying speed of a recording material). In such a rotation process, the photosensitive drum 101 is uniformly electrified by an electrification apparatus 102 such as an electrification roller or the like so that the outer surface thereof has predetermined polarity and potential.

Then, a laser beam 103 from a laser scanner (laser optical box) 110 is scanned and exposed on the surface of the electrified photosensitive drum 101, whereby an electrostatic latent image corresponding to target image information is formed on this surface. A time-series electrical digital image signal representing the target image information is transmitted from an image signal generating apparatus such as a not-shown image reader or the like to the laser scanner 110, the laser scanner 110 modulates (ON/OFF) and outputs the laser beam 103 in correspondence with the received image signal, and the output laser beam 103 is deflected toward the photosensitive drum 101 by a deflection mirror 109, whereby the surface of the photosensitive drum 101 is scanned and exposed by the laser beam 103.

When a full-color image is formed, scan, exposure and latent image formation are performed to a first color separation component image, e.g., a yellow component image, of a target full-color image, the formed latent image is developed by a yellow developing device 104Y of a four-color developing apparatus 104, and the developed image is visualized as a yellow toner image. The obtained yellow toner image is transferred to the outer surface of an intermediate transferring drum 105 by a primary transferring portion Ti functioning as the contact portion or the adjacency portion between the photosensitive drum 101 and the intermediate transferring drum 105 (primary transferring). After the toner image was transferred to the intermediate transferring drum 105, an adhering residue such as residual toner or the like on the surface of the photosensitive drum 101 is eliminated by a cleaner 107, whereby the photosensitive drum 101 is cleaned and then used for the image formation again.

Such a process cycle as above including the electrification, the scan, the exposure, the development, the primary transferring and the cleaning is sequentially performed to each of a second color separation component image (e.g., a magenta component image, developed by a magenta developing device 104M) of the target full-color image, a third color separation component image (e.g., a cyan component image, developed by a cyan developing device 104C), and a four color separation component image (e.g., a black component image, developed by a black developing device 104Bk). Thus, the color image in which the toner images of four colors (yellow, magenta, cyan and black) are sequentially superposed is formed, whereby a composite color image corresponding to the target full-color image can be obtained.

The intermediate transferring drum 105 which is formed by providing an intermediate-resistance elastic layer and a high-resistance surface layer on a metallic drum comes into contact with or is adjacent to the photosensitive drum 101, and is rotatively driven clockwise as indicated by the arrow at the speed same as that of the photosensitive drum 101. If a bias potential is given to the metallic drum of the intermediate transferring drum 105, the toner image on the photosensitive drum 101 is transferred to the surface of the intermediate transferring drum 105 due to a potential difference between the drums 101 and 105.

The color image formed on the intermediate transferring drum 105 is transferred to the surface of a recording material P such as a sheet or the like by a secondary transferring portion T2 functioning as the contact nip portion between the intermediate transferring drum 105 and the transferring roller 106 (secondary transferring). The recording material P is, fed from a not-shown sheet feeding portion to the secondary transferring portion T2 at predetermined timing, the transferring roller 106 nips and presses the fed recording material P against the surface of the drum, and an electric charge the polarity of which is opposite to that of the toner applied to the transferring roller 106 is supplied from the back of the recording material P, whereby the four color toner images constituting the color image on the intermediate transferring drum 105 are collectively transferred to the surface of the recording material P.

The recording material P passed the secondary transferring portion T2 is separated from the surface of the intermediate transferring drum 105 and introduced into the fixing apparatus 100, the four color toner images are subjected to a heating fixing process to be formed as the four-color (full-color) image, and after that the processed recording material P is discharged to a not-shown sheet discharge tray outside the image forming apparatus. On the other hand, after the toner images are transferred to the recording material P, an adhering residue such as residual toner, paper dust or the like is eliminated from the surface of the intermediate transferring drum 105 by a cleaner 108, whereby the intermediate transferring drum 105 is cleaned.

In ordinary time, the cleaner 108 is maintained in a noncontact state that the cleaner 108 does not come into contact with the intermediate transferring drum 105. On the other hand, in the secondary transferring execution process of transferring the color image on the intermediate transferring drum 105 to the recording material P, the cleaner 108 is maintained in a contact state that the cleaner 108 comes into contact with the intermediate transferring drum 105. Also, in the ordinary time, the transferring roller 106 is maintained in the noncontact state for the intermediate transferring drum 105, while in the secondary transferring execution process, the transferring roller 106 is maintained in the contact state for the intermediate transferring drum 105 via the recording material P.

As the conveying speeds of the recording material, i.e., the fixing speeds, the image forming apparatus in the present embodiment includes three speeds in total, i.e., ordinarily used 100 mm/sec, and other 50 mm/sec and 25 mm/sec. In the present embodiment, since the toner image on the photosensitive drum 101 is first primary transferred to the intermediate transferring drum 105, the respective components such as the developing apparatus 104, the transferring apparatuses (the intermediate transferring drum 105 and the transferring roller 106) and the like are rotatively driven at the circular speed corresponding to the conveying speed 100 mm/sec until the above primary transferring process ends, and after that the speed is changed to the predetermined conveying speed, i.e., the fixing speed, from the feeding of the recording material P until the secondary transferring process and the fixing process ends.

Figure 3:
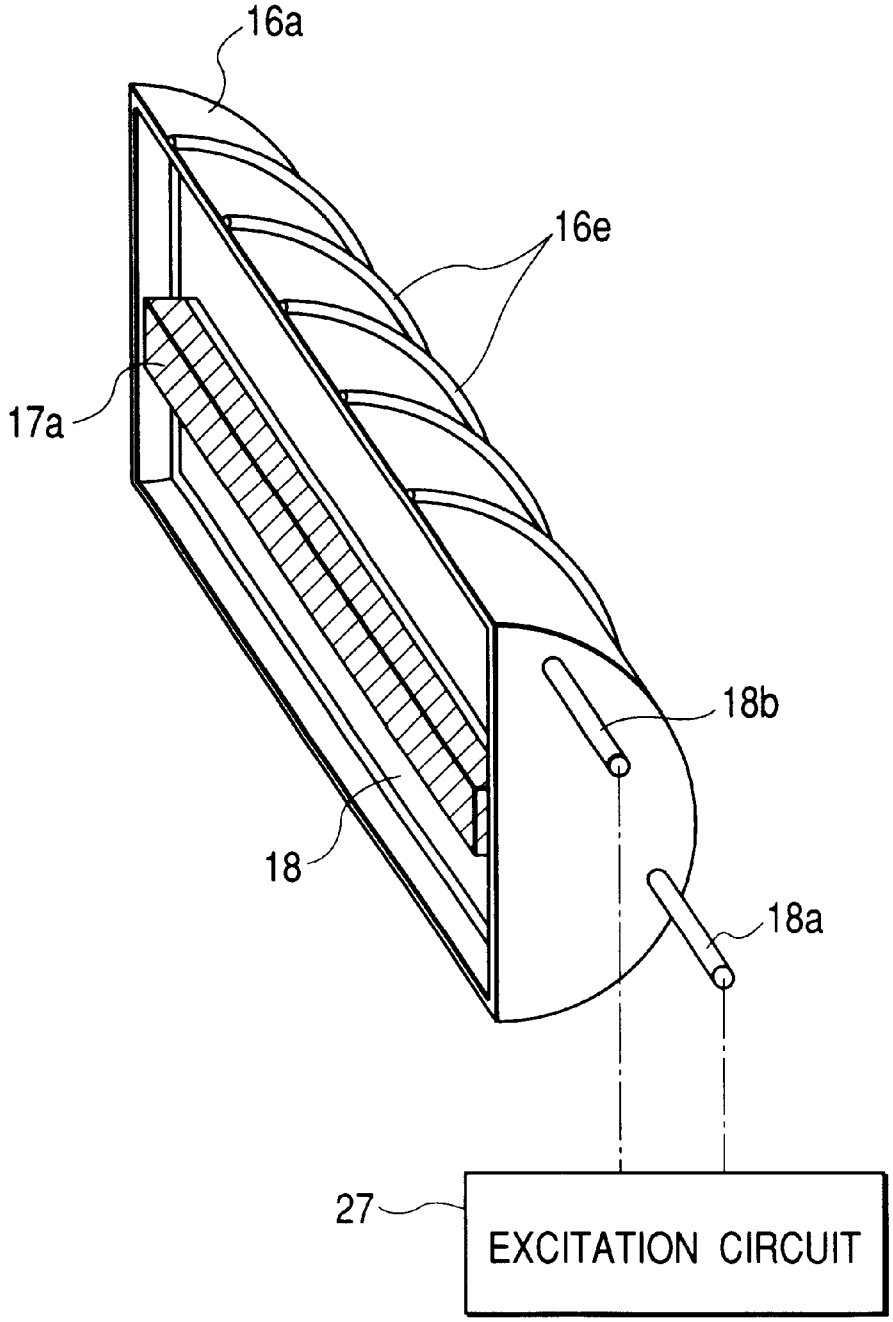
FIG. 3 is a perspective illustration showing the section of the fixing apparatus along the line III—III of FIG. 2.
Figure 4:
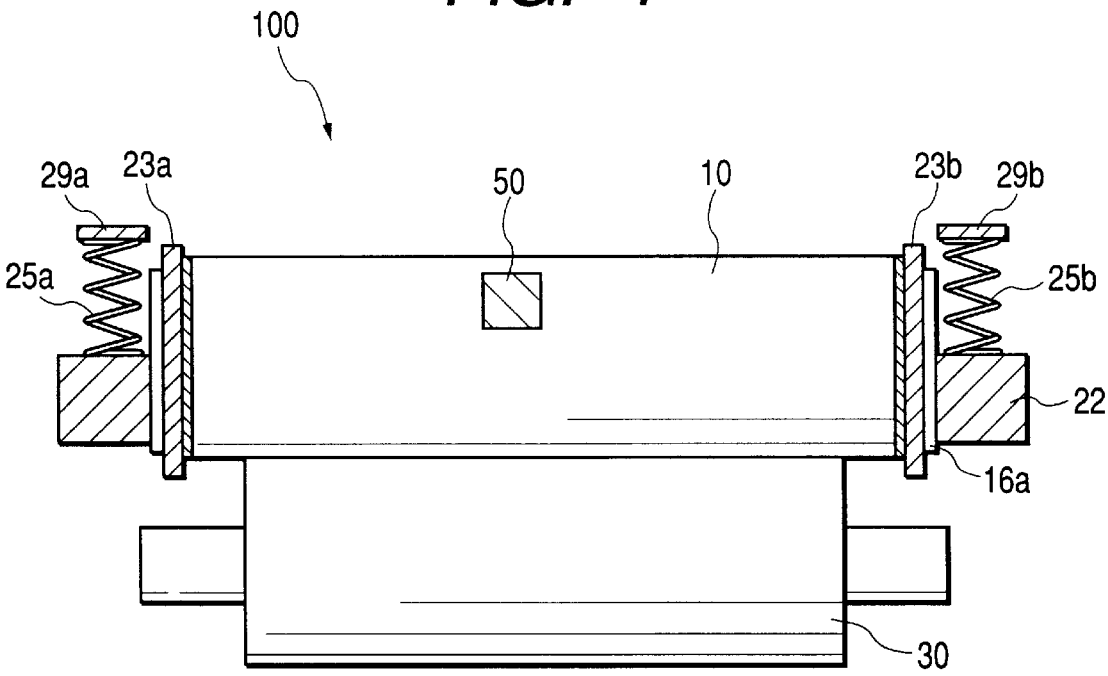
FIG. 4 is a front elevation of the fixing apparatus seen from the direction A of FIG. 2.
Figure 5:
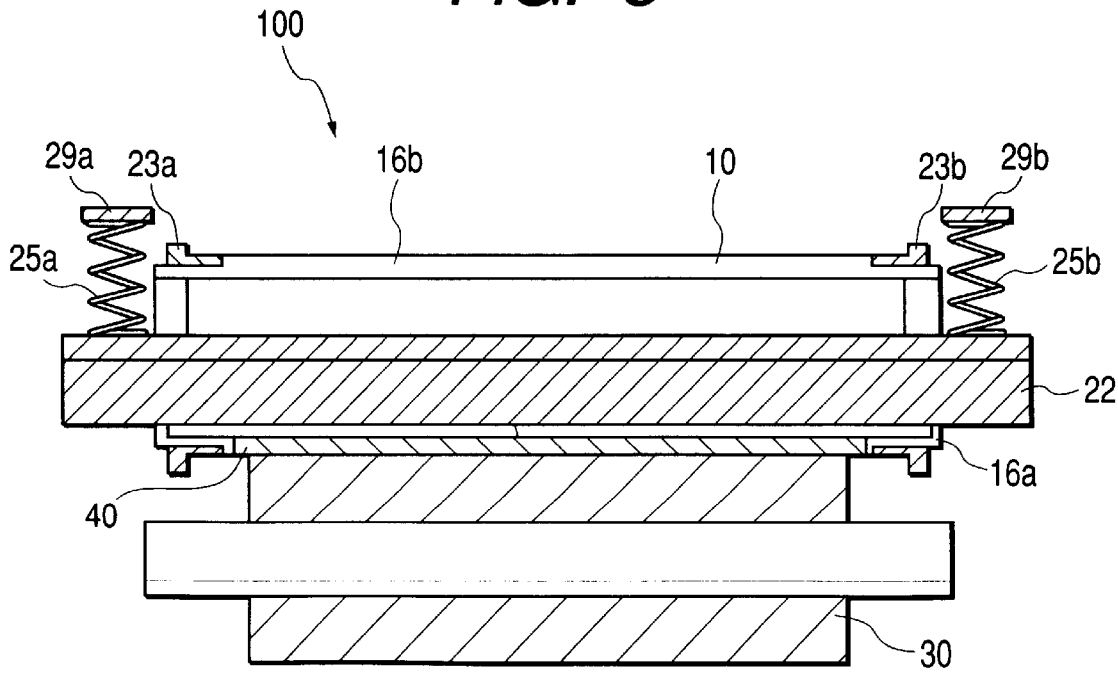
FIG. 5 is a cross-sectional view of the fixing apparatus along the line V—V of FIG. 2.

Then, the fixing apparatus will be explained with reference to FIGS. 2 to 5. Here, FIG. 2 is the longitudinal section showing the fixing apparatus, FIG. 3 is the perspective illustration showing the section along the line III—III of FIG. 2, FIG. 4 is the front elevation seen from the direction A of FIG. 2, and FIG. 5 is the cross-sectional view along the line V—V of FIG. 2.

In the present invention, the fixing apparatus 100 is assumed to be a film heating system using a cylindrical fixing film, and in the present embodiment, the fixing apparatus 100 is assumed to be an electromagnetic induction heating system further including a conductive layer in the fixing film.

Figure 2:
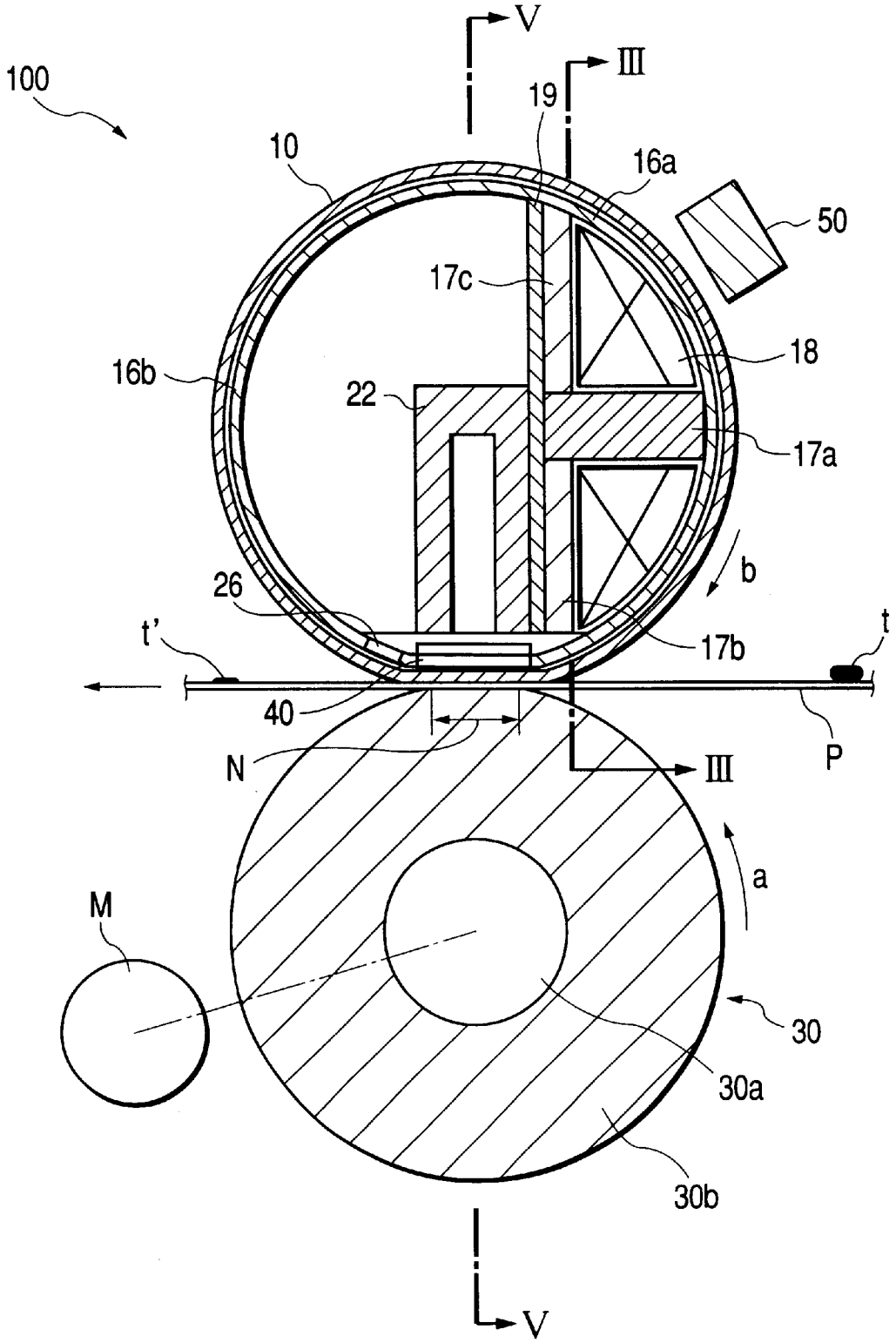
FIG. 2 is a longitudinal section showing a fixing apparatus equipped on the image forming apparatus of FIG. 1.

As shown in FIG. 2, the fixing apparatus 100 includes a fixing portion (heating means) having a fixing film (moving member) 10 and a pressurizing portion composed of a pressurizing roller 30, and the recording material P fed from the secondary transferring portion is passed a fixing nip portion N formed between the fixing film 10 and the pressurizing roller 30, whereby a toner image t is heated and fixed to the recording material P.

Gutter-like large and small film guide members 16*b* and 16*a* each of which has the semicircle-arc section are provided on the fixing portion, and the opening sides of the guide members 16*a* and 16*b* are mutually opposite and approximately compose a cylindrical shape, and the cylindrical fixing film 10 is loosely wrapped around the outer surface of the assembly (cylinder) of the guide members 16*a* and 16*b*. In the present embodiment, this is described later though the fixing film 10 is formed to three-layer structure including a conductive layer.

The film guide member 16 (16*a* and 16*b*) acts to support the pressurization to the fixing nip portion and support an excitation coil 18 or the like functioning as a magnetic field generating means, and aims at the conveying stability when the fixing film 10 is rotated. As shown in FIGS. 4 and 5, flange members 23*a* and 23*b* are fitted respectively into the left and right both ends of the assembly of the film guide member 16, whereby the flange member 23 (23*a* and 23*b*) is rotatively mounted on the assembly of the film guide member 16 as fixing the left and right positions of the assembly. When the fixing film 10 is rotated, the flange member 23 catches the ends the film to regulate the warped shift of the film along the longitudinal direction of the film guide member 16.

The film guide member 16 has insulation not preventing permeation of the magnetic flux, and is formed with a material endurable for a heavy load. For example, a polyimide resin, a polyamide resin, a polyamide-imide resin, a polyether ketone resin, a polyether sulfone resin, a polyphenylene sulfide resin, a liquid crystal polymer and the like can be used as the film guide member 16.

Magnetic cores 17*a*, 17*b* and 17*c* are arranged like a character T inside the smaller film guide member 16*a*, and the excitation coil 18 is held in the space surrounded by the magnetic cores 17*a*, 17*b* and 17*c* and the film guide member 16*a*. A pressurizing rigidity stay 22 of which section is like an angular character U and oblong is pressed against the inside surface of the plane of the larger film guide member 16*b*, and a slidable member 40 directed toward the same direction as that perpendicular to the sheet surface of FIG. 2 is provided on the outside surface of the plane of the film guide member 16*b*.

As shown in FIG. 3, an excitation circuit 27 is connected to the excitation coil 18 by power supply portions 18*a* and 18*b*, whereby the magnetic cores 17*a* to 17*c*, the excitation coil 18 and the excitation circuit 27 together constitute the magnetic field generating means. The excitation circuit 27 can generate high frequencies from 20 kHz to 500 kHz by using a switching power supply, and the excitation coil 18 generates alternating magnetic flux on the basis of an alternating current (high-frequency current) supplied from the excitation circuit 27.

The excitation coil 18 is formed by winding a line plural times, here, the wound line is formed by winding plural thin leads each insulation-coated. It should be noted that, in the present embodiment, the excitation coil 18 includes the ten-turned wound line. The shape of the excitation coil 18 is formed to be fitted into the curved surface of the fixing film 10. Here, it is assumed that the distance between the excitation coil 18 and the conductive layer of the fixing film 18 is about 2 mm.

The insulation material used to insulation-coat the thin leads of the wound line desirably has heat resistivity in consideration of heat conductivity due to the heat generation (exothermicity) of the fixing film 10, and, for example, amide-imide, polyimide or the like is desirable. When the line is wound, the winding concentration may be increased by externally applying force. Further, as to the power supply portions 18*a* and 18*b* extending from the excitation coil 18, the outside of the bunch line constituting each power supply portion is insulation-coated.

Each of the magnetic cores 17*a* to 17*c* consists of a high-permeability material, and, for example, the material such as ferrite, permalite or the like used for the core of a transformer is desirable. Particularly, the ferrite with a little magnetic loss even at 100 kHz or more is desirably used.

The magnetic cores 17*a* to 17*c* are insulated from the pressurizing rigidity stay 22 by an insulation member 19. As the insulation member 19, a material with high heat resistivity in addition to excellent insulation is desirable. For example, a phenolic resin, a fluoroplastic, a polyimide resin, a polyamide resin, a polyamide-imide resin, a polyether ketone resin, a polyether sulfone resin, a polyphenylene sulfide resin, a PFA resin, a PTFE resin, an FEP resin, an LCP resin or the like can be used.

From the viewpoint of absorption of the magnetic flux, the distance between the fixing film 10 and the unit of the magnetic cores 17*a* to 17*c* and the excitation coil 18 should be as short as possible. If this distance is 5 mm or less, the fixing film can high-efficiently absorb the magnetic flux, while if this distance exceeds 5 mm, the absorption efficiency of the magnetic flux remarkably decreases. Here, this distance only has to be 5 mm or less but need not be a specific value.

The slidable member 40 is the member for supporting the fixing film 10 from its inner surface side against the pressure by the pressurizing roller 30, whereby the slidable member 40 and the pressurizing roller 30 are pressure-contacted by the pressure via the fixing film 10. Thus, the fixing film 10 enters the state placed between the pressurizing roller 30 and the slidable member 40, whereby the fixing nip portion N having a predetermined width is formed at the pressure-contacted portion between the fixing film 10 and the pressurizing roller 30.

As the material of the slidable member 40, a material having lubricity such as a fluoroplastic, a glass, boron nitride, graphite or the like is enumerated. If the material has excellent heat conductivity in addition to the lubricity, such the material is more desirable. That is, if the slidable member 40 is formed by the material having excellent heat conductivity, the effect that the temperature distribution in the longitudinal direction can be made uniform is achieved. For example, if a small-sized recording material is passed, the heat amount at a recording material non-pass portion of the fixing film 10 on which the recording material does not pass is heat-transferred to the slidable member 40, and the heat amount of this recording material non-pass portion is heat-transferred to the portion on which the small-sized recording material passes because of the heat conductivity of the slidable member along its longitudinal direction, whereby it is possible to achieve the effect of decreasing power consumption when the small-sized recording material is passed.

As such the material having excellent heat conductivity, a compound material of a metal such as mirror-ground aluminum and a metal on which lubricant such as fluoroplastic particles, boron nitride resin particles, graphite particles or the like have been distributed is enumerated. Further, the slidable member 40 may be a material of two layer structure of the above material having excellent heat conductivity has been coated with the lubricant material, e.g., a nitride aluminum board has been coated with a glass. In the present embodiment, an alumina board that has been coated with the glass is used as the slidable member 40.

If the slidable member 40 having conductivity is used, it is desirable to dispose the slidable member 40 outside the magnetic field so that this member 40 is not influenced by the magnetic field generated from the excitation coil 18 of the magnetic field generating means. Concretely, the slidable member 40 is disposed at the position apart from the excitation coil 18 by the magnetic core 17*c*, whereby this member 40 is disposed outside the magnetic path of the excitation coil 18.

To further decrease sliding frictional force between the slidable member 40 and the fixing film 10 at the fixing nip portion N, a lubricant such as heat-resistive grease or the like can be put between the slidable member 40 and the fixing film 10. By putting such the lubricant, sliding resistance can be further decreased and the apparatus itself can be made long-lived.

The pressurizing roller 30 functioning as the pressurizing member consists of a core metal 30*a* and a heat-resistive elastic material layer 30*b* such as a silicone rubber, a fluorine rubber, a fluoroplastic or the like. Here, the layer 30*b* is formed integrally around the core metal 30*a* like a roller to coat this core metal. Further, the pressurizing roller 30 is rotatively mounted to the fixing apparatus 100 if both the ends of the core metal 30*a* are borne and held between the side boards (plates) of a not-shown chassis of the fixing apparatus 100.

As shown in FIG. 4, spring stops 29*a* and 29*b* on the side of the chassis are equipped respectively with pressurizing springs 25*a* and 25*b* shrinkingly disposed between the both ends of the pressurizing rigidity stay 22, the stay 22 is pressed downward by expansion force of the springs 25*a* and 25*b*, whereby the lower surface of the slidable member 40 provided on the film guide member 16*b* and the upper surface of the pressurizing roller 30 are pressure-contacted via the fixing film 10. Thus, as described above, the fixing nip portion N having the predetermined width is formed.

In the full-color image forming apparatus, the width of the fixing nip portion of the fixing apparatus is desirably 7.0 mm or more, whereby the fixation of the full-color image of which the amount of the adhered toners is large can be sufficiently secured. Conversely, if the width of the fixing nip portion N is less than 7.0 mm, the heat amount sufficient for the fixing can not be given to the recording material P and the toners thereon, whereby defective fixing is caused.

Then, the surface pressure of the fixing nip portion N is desirably 0.8 kgf/cm2 (7.84×104 Pa) or more. By such the surface pressure, transparentness of the full-color fixed image can be sufficiently secured even if an OHP film is used as the recording material P. Conversely, if the surface pressure is less than 0.8 kgf/cm2, the surface of the fixed image can not be sufficiently smoothed, whereby diffuse-reflected light increases, and also the amount of transparency of the fixed image on the OHP film decreases.

From the above point of view, in the present embodiment, the pressurizing roller 30 and the fixing film 10 of the fixing apparatus are pressure-contacted at the pressure 21 kgf (205.8N), the width of the fixing nip portion N is set to about 8.0 mm, and the surface pressure is set to 1.2 kgf/cm$^2$. Here, the length of the fixing nip portion N is 220 mm in its longitudinal direction.

The pressurizing roller 30 is rotatively driven counter-clockwise as indicated by the arrow a with a driving means M shown in FIG. 2. By such the rotation of the pressurizing roller 30, the friction force is produced between the outer surface of the pressurizing roller 30 and the outer surface of the fixing film 10, whereby the rotation power acts on the fixing film. Then, the fixing film is rotated clockwise as indicated by the arrow b around the outer surface of the film guide members 16*a* and 16*b* at the circular speed approximately corresponding to the circular speed of the pressurizing roller 30, as causing its inner circumferential surface to tightly contact the lower surface of the slidable member 40. That is, by the friction force produced between the fixing film 10 and the surface of the pressurizing roller 30, the film 10 is rotated pursuant to the rotation of the pressurizing roller 30.

To decrease sliding resistance due to the contact between the circumferential surface of the film guide member 16*a* and the inner surface of the fixing film 10, plural projecting ribs 16*e* are provided around the film guide member 16 at a predetermined interval along the longitudinal direction of the guide member, as shown in FIG. 3. Thus, a rotation load of the fixing film 10 is lowered. It should be noted that such the ribs can be provided around the film guide member 16*b*.

Figure 6A:
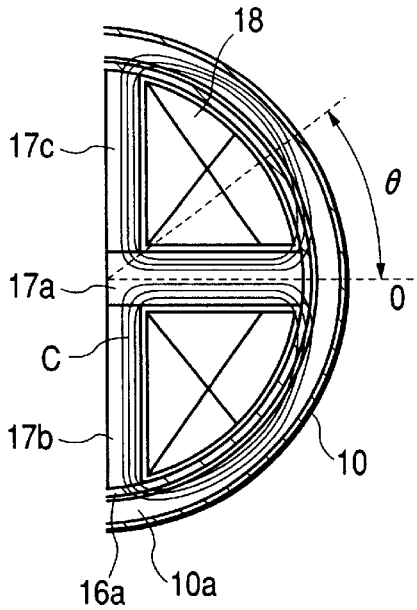
FIGS. 6A and 6B are views showing the relation between alternating magnetic flux of a magnetic field generating means and a calorific value of a fixing film in the fixing apparatus of FIG. 2.

FIGS. 6A is a view schematically showing the state of the alternating magnetic flux generated by the magnetic field generating means. In FIG. 6A, symbol C denotes the generated alternating magnetic flux, and a part of the generated alternating magnetic flux is illustrated. The alternating magnetic flux C is generated by the induction of the magnetic cores 17*a*, 17*b* and 17*c*, and eddy currents are generated in a conductive layer 10*a* of the fixing film 10 between the magnetic cores 17*a* and 17*b* and between the magnetic cores 17*a* and 17*c*, respectively. Then, the eddy current generates Joule heat (eddy-current loss) in the conductive layer by the specific resistance of the conductive layer 10*a*.

Figure 6B:
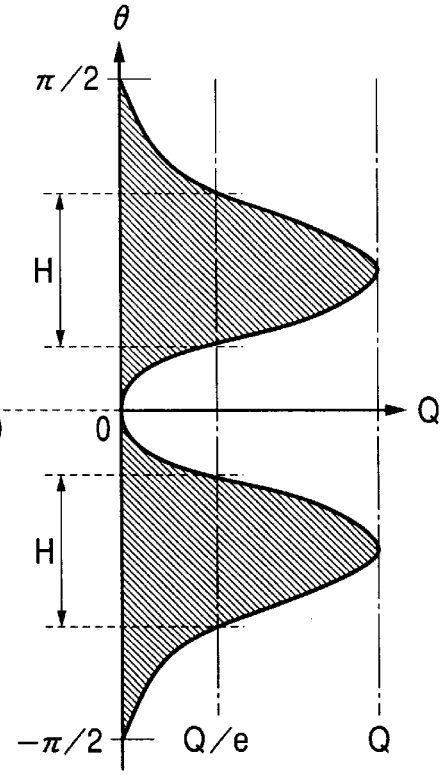

A calorific value Q of the conductive layer 10*a* is determined by the density of the alternating magnetic flux C penetrating the conductive layer, and has the distribution like the graph shown in FIG. 6B. In FIG. 6B, the vertical axis indicates the position on the circumferential direction of the fixing film 10 represented by an angle θ to the line passing the center of the magnetic core 17*a*, and the horizontal axis indicates the calorific value Q of the conductive layer 10*a* at that position. Heat generating (exothermic) areas H in the graph of FIG. 6B are defined as the area where the calorific value equal to or larger than Q/e can be obtained if the maximum calorific value is given as Q (e is base of natural logarithm). The heat generating area H is the area from which the calorific value necessary in the fixing process can be obtained.

The temperature of the fixing nip portion N is controlled by a temperature control system including a temperature sensor 26 so that a predetermined temperature is maintained. The temperature sensor 26 is a temperature detecting element such as a thermistor or the like for detecting the temperature of the fixing film 10, and is disposed at a suitable position on the fixing film 10, e.g., the position between the fixing film 10 and the film guide member 16*b* in the vicinity of the fixing nip portion N in the present embodiment. A CPU (not shown) in the body of the image forming apparatus controls current supply to the excitation coil 18 on the basis of temperature information of the fixing film 10 detected by the temperature sensor 26, thereby controlling the fixing nip portion N to be maintained at the predetermined temperature. In the present embodiment, the control temperature can be changed by the CPU in correspondence with the recording material conveying speed. The temperature control will be described later.

In the present embodiment, since the toner including a low softening point material is used, any oil spreading mechanism for preventing an offset is not provided in the fixing apparatus 100. Of course, when toner not including any low softening point material is used, an appropriate oil spreading mechanism may be provided. Further, even if the toner including the low softening point material is used, the oil spreading mechanism may be provided. Besides, cooling separation may be performed.

A thermostatic switch 50 which is a kind of the temperature detecting element is provided in the fixing apparatus 100 to interrupt electric supply to the excitation coil 18 when thermal runaway occurs. The thermostatic switch 50 is arranged outside the fixing film 10 so that the switch 50 opposes to the heat generating area H and is in noncontact with the film 10. The thermostatic switch 50 is set to be in noncontact with the fixing film 10, and the distance between the thermostatic switch 50 and the fixing film 10 is set to about 2 mm to prevent deterioration of the fixing image due to the scratches occurring on the fixing film because of long-term use. Besides, it is possible to cause the thermosensitive portion of the thermostatic switch 50 to come into contact with the fixing film 10.

In the present embodiment, since the structure that heat is generated from the fixing nip portion N is not adopted, when the fixing apparatus 100 causes thermal runaway due to a breakdown in the temperature control, even if the situation that the heat generation of the fixing film 10 continues without interrupting the electric supply to the excitation coil 18 occurs as the fixing apparatus has stopped in the state that it nips the recording material P at the fixing nip portion N, the recording material P is not heated directly.

Figure 7:
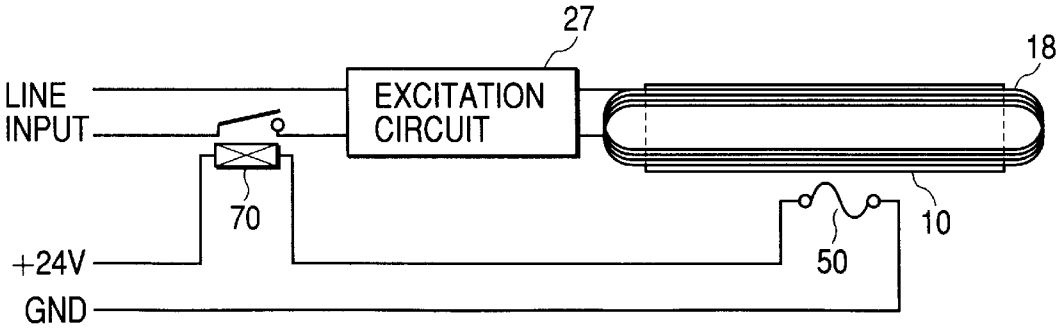
FIG. 7 is a view showing a thermal runaway prevention circuit provided in the fixing apparatus of FIG. 2.

As shown in FIG. 7, a thermal runaway prevention circuit incorporates therein the thermostatic switch 50, and the thermostatic switch 50 is connected in series to a DC power supply +24V via a relay switch 70. In the present embodiment, an open operation temperature of the contact point of the thermostatic switch 50 is set to 220° C. Therefore, if the thermostatic switch 50 detects a temperature equal to or higher than 220° C., its contact point is cut, the relay switch 70 operates in response to the interruption of the electric supply, and the electric supply to the excitation coil 18 is interrupted based on the interruption of the electric supply to the excitation circuit 27. Thus, the heat generation of the fixing film 10 can be prevented, and the sheet (paper) as the recording material does not ignite resultingly because the ignition point temperature of the sheet is about 400° C.

Although the thermostatic switch 50 adopts a noncontact system as for the fixing film 10, a thermostatic switch of contact system may be used. Besides, a temperature fuse may be used instead of the thermostatic switch.

When the toner image is fixed by the fixing apparatus 100, the fixing film 10 is rotated by the rotation of the pressurizing roller 30, the electric supply to the excitation coil 18 is performed by the excitation circuit 27, heat is generated from the fixing film 10 due to electromagnetic induction, and the fixing nip portion N is risen to a predetermined fixing temperature. Then, the recording material P adhering the toner image on the side of the fixing film 10 and conveyed from the secondary transferring portion is introduced into the fixing nip portion N in the state that the fixing temperature is maintained by the temperature control. As shown in FIG. 2, the surface of the toner image t side of the recording material P is tightly contact with the outer surface of the fixing film 10, and the recording material P is nipped and conveyed together with the fixing film 10. Then, while the recording material P is passing the fixing nip portion N, the toner image is heated and fixed to the recording material P. The recording material P passed the fixing nip portion N is separated from the surface of the fixing film 10 and then discharged, and a fixed toner t' is cooled, whereby a permanent fixation image is obtained.

Figure 8:
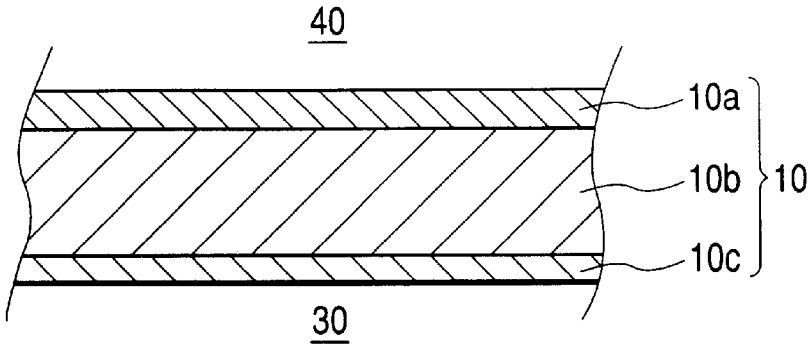
FIG. 8 is a typical view showing the layer structure of the fixing film in the fixing apparatus of FIG. 2.

The fixing film 10 will be explained. As shown in FIG. 8, the fixing film 10 is formed to the three-layer structure which includes the conductive layer 10*a* also functioning as the film substrate layer made by a metallic film or the like, an elastic layer 10*b* laminated to the surface of one side of the conductive layer 10*a*, and a mold release layer 10*c* laminated to the elastic layer 10*b*. Here, primer layers may be disposed between the conductive layer 10*a* and the elastic layer 10*b* and between the elastic layer 10*b* and the mold release layer 10*c* to strengthen the adhesion between these layers. The fixing film 10 is formed cylindrically such that the conductive layer 10*a* is positioned on the inside being in contact with the slidable member 40 and the mold release layer 10*c* is positioned on the outside being in contact with the pressurizing roller 30.

As described above, the eddy current is generated in the conductive layer 10*a* and the heat is thus generated by the alternating magnetic flux acting on the conductive layer, and the generated heat is transferred to the elastic layer 10*b* and the mold release layer 10*c*, whereby the fixing film 10 is heated as a whole.

Although magnetic and nonmagnetic metals can be used as the conductive layer 10*a*, it is desirable to use the magnetic metal. As such the magnetic metal, a ferromagnetic metal such as nickel, iron, ferromagnetic stainless steel, nickel-cobalt alloy, Permalloy or the like is desirable. To prevent metal fatigue caused by repeatedly receiving flexure stress while the fixing film is being rotated, a material adding manganese in the nickel can be used.

Figure 9:
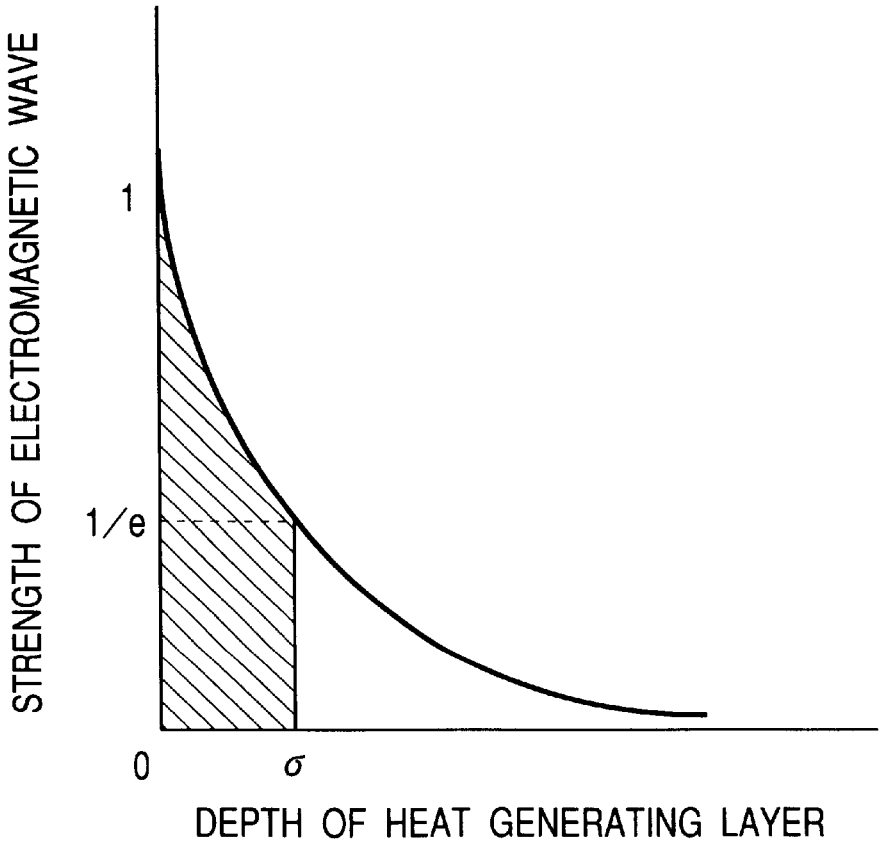
FIG. 9 is a view for explaining the relation between a heat generating depth of the fixing film of FIG. 8 and electromagnetic wave intensity.

It is desirable to set the thickness of the conductive layer 10*a* to be heavier than a skin depth a represented by the next equation (1) and equal to or smaller than 200 μm. If this thickness can be set within such a range, the conductive layer 10*a* efficiently absorbs an electromagnetic wave, whereby the heat can be efficiently generated. As shown in FIG. 9, the skin depth σ is the depth of the heat generating layer (the conductive layer) where the intensity of the electromagnetic wave used in the electromagnetic induction decreases to 1/e, and the majority of electromagnetic energy is absorbed before the depth σ.

$$\sigma(m)=503\times(\rho/f\mu)^{1/2} \quad (1)$$

where f is a frequency (Hz) of the excitation circuit, μ is magnetic permeability, and ρ is a specific resistance (Ωm) of the conductive layer.

If the thickness of the conductive layer 10*a* is thinner than the skin depth σ, heating efficiency is lowered because the absorption of electromagnetic energy is small. If the thickness exceeds 200 μm, rigidity of the conductive layer 10*a* rises too much, and flexibility thereof deteriorates, whereby using the conductive layer 10*a* as a rotator becomes not realistic. More desirable thickness of the conductive layer 10*a* is 1 μm to 100 μm.

It is desirable to use, as the elastic layer 10*b*, a material of excellent heat resistivity and heat conductivity such as silicone rubber, fluoric rubber, fluorosilicone rubber or the like.

It is desirable to set the thickness of the elastic layer 10*b* to about 10 μm to 500 μm so that the heating surface (the mold release layer 10*c*) of the fixing film 10 can follow unevenness of the recording material and the toner image. More desirable thickness of the elastic layer 10*b* is 50 μm to 500 μm.

If the thickness of the elastic layer 10*b* is thinner than 10 μm, the heating surface can not follow the unevenness of the recording material and the toner image in case of printing a color image, particularly, a color photographic image or the like with which a solid image might be formed over the wide area on the recording material. Thus, unevenness in gloss that the gloss level is high in the part where a heat transferring amount is large while the gloss level is low in the part where the heat transferring amount is small occurs, whereby guarantee of quality of the fixed image becomes difficult. If the thickness of the elastic layer 10*b* exceeds 500 μm, achieving a quick start becomes difficult because the heat resistance in the elastic layer increases too much.

If the hardness of the elastic layer 10*b* increases too much, the layer 10*b* can not follow the unevenness of the recording material and the toner image, whereby the unevenness in gloss occurs. For this reason, it is desirable to use the elastic layer of JIS-A hardness 60° or less, preferably 45° or less.

Heat conductivity λ of the elastic layer 10*b* is desirably $6\times10^{-4}$ to $2\times10^{-3}$ cal/cm·s·deg ($2.51\times10^{-5}$ to $8.37\times10^{-5}$ W/cm·deg). If the heat conductivity λ is smaller than $6\times10^{-4}$ cal/cm·s·deg, the heat resistance is too large, whereby the temperature rise on the surface (the mold release layer 10*c*) of the fixing film 10 slows. On the other hand, if the heat conductivity λ is larger than $2\times10^{-3}$ cal/cm·s·deg, the hardness of the elastic layer 10*b* increases too much, and it becomes easy for a compressive permanent set to occur. It should be noted that more desirable heat conductivity λ is $8\times10^{-4}$ to $1.5\times10^{-3}$ cal/cm·s·deg ($3.35\times10^{-5}$ to $6.29\times10^{-5}$ W/cm·deg).

As the mold release layer 10*c*, it is desirable to use a material of excellent mold releasability and heat resistivity such as a fluoroplastic, a silicone resin, fluorosilicone rubber, fluoric rubber, silicone rubber, PFA, PTFE, FEP or the like. The mold release layer 10*c* can be formed as a coated layer of such the material as above.

The thickness of the mold release layer 10*c* is desirably 1 μm to 100 μm. If the thickness of the mold release layer 10*c* is thinner than 1 μm, unevenness coating of the mold release layer occurs, whereby the problems that the part where mold releasability is poor occurs and that durability is insufficient are caused. On the other hand, if the thickness thereof exceeds 100 μm, heat conductivity deteriorates.

Then, the temperature control for the fixing film in the present invention will be explained. In the present embodiment, the temperature control is performed by PID. First, its environmental technical matters will be explained.

Heat energy generated in the conductive layer 10*a* of the fixing film 10 is proportional to the square of the intensity of the eddy current, and the intensity of the eddy current is proportional to the square of alternating magnetic field (alternating magnetic flux, energy. It only has to increase the magnetic field energy to the excitation coil 18 to raise the temperature of the fixing film 10. Conversely, it is only necessary to decrease the magnetic field energy to decrease the temperature of the fixing film 10.

As such the increase/decrease of the magnetic field energy, it is possible to increase and decrease the voltage to be applied to the excitation coil 18, or to increase or decrease the current flow. Since a usual domestic power supply may be considered as a constant-voltage power supply, if it is intended to structure the power supply for fixing inexpensively by using the domestic power supply, it is desirable to adopt the method of increasing and decreasing the current flow in the excitation coil 18.

Within the range that an electromagnetic circuit composed of the magnetic field generating means and the power supply for the fixing satisfies a resonance condition, the increase/decrease of the current can be controlled based on the length of the time (called the voltage applying time hereinafter) for applying the voltage to the excitation coil 18. That is, a switching element such as an IGBT (Insulated Gate Bipolar Transistor) or the like is provided as a power control means, the current is thus switched or changed in synchronism with an oscillation period of the magnetic field in the electromagnetic circuit, and the voltage applying time and a release time are changed, whereby the temperature of the fixing film can be changed. In the present embodiment, the release time is fixed to 6 μs, and the voltage applying time can be changed within the range of 1 μs to 20 μs.

A CPU (not shown) functioning as an operating amount determining means for the switching element is provided in the image forming apparatus. The CPU samples at a certain interval the temperature information of the fixing film 10 obtained from the temperature sensor 26, calculates the above voltage applying time by the following control rule, and then causes a rectangular wave generating circuit to output a predetermined voltage to the switching element by the calculated time.

In the present embodiment, the PID control is adopted as the method of calculating the voltage applying time. In the PID control, if it is assumed that m is the operating amount and e is the deviation, the operating amount m is determined by the equation (2) of the control rule including three parameters, i.e., a proportional gain K, an accumulated time TI and a differential time TD.

$$m=K(e+1/TI\cdot\int edt+TD\cdot de/dt) \quad (2)$$

Here, it is assumed that the deviations between the target temperature and the sampled temperature of the fixing film are e(n), e(n−1) and e(n−2) in order of time, the sampling time is Ts, the voltage applying time at this time is m(n), and the last voltage applying time is m(n−1). In such a condition, if the equation (2) is made discrete, the following equation (3) is obtained.

$$m(n)=m(m-1)+K(e(n)-e(n-1))+KTs/TI\cdot e(n)+KTD/Ts\cdot\{(e(n)-e(n-1))-(e(n-1)-e(n-2))\} \quad (3)$$

The operating amount m(n) of the switching element is calculated from the control rule of the equation (3). That is, the voltage applying time m(n) at this time is determined by adding the following three elements to the last operating amount m(n−1).

$$\text{proportional control amount: } K(e(n)-e(n-1)) \quad (4)$$

$$\text{integral control amount (including proportional gain): } KTs/TI\cdot e(n) \quad (5)$$

$$\text{differential control amount (including proportional gain): } +KTD/Ts\cdot\{(e(n)-e(n-1))-(e(n-1)-e(n-2))\} \quad (6)$$

The feature of the present embodiment is to change the value of the proportional gain K in the PID control according to the fixing speed (same as the conveying speed of the recording material). Although the integral time TI and the differential time TD are constant irrespective of the fixing speed, such the integral time TI and the differential time TD may be changed according to the fixing speed. Further, although the PID control is adopted, the PI control or the PD control may be adopted.

It is necessary to decrease the proportion gain K as the fixing speed, i.e., the rotation speed of the fixing film 10, decreases. Since the time for the fixing film to pass the heat generating area H elongates as the fixing speed decreases, the temperature change of the fixing film relative to the change in the supplied power increases. For this reason, if the value of the proportional gain K is large when the fixing speed is low, the calculation result of the operating amount of the switching element in the PID control vibrates easily, whereby there is a tendency that the temperature of the fixing film does not easily converge on the target temperature because of overshoot and undershoot. Conversely, if the value of the proportional gain K is small when the fixing speed is high, there is a tendency not to be able to follow the temperature change of the fixing film due to a disturbance.

In the present embodiment, as described above, the three fixing speeds (the recording material conveying speeds) are set for the fixing apparatus. As shown in Table 1, the proportional gain K is set for each of the three fixing speeds $V_F$, and the value of the proportional gain K is obtained by the adjustment in the real machine of the fixing apparatus and thus can be different according to each fixing apparatus.

TABLE 1

| $V_F$ | K |
|---|---|
| 100 mm/sec | 4 |
| 50 mm/sec | 3 |
| 25 mm/sec | 2.5 |

Therefore, according to the present embodiment, the CPU of the image forming apparatus calculates an ON time of the switching element according to the control rule in the PID control by referring to, in Table 1, the proportional gain K for the fixing speed according to a driving speed signal of the fixing apparatus. Then, by controlling and adjusting the voltage applying time to the excitation coil on the basis of ON/OFF control of the switching element, the temperature control of the fixing film is performed.

Figure 10A:
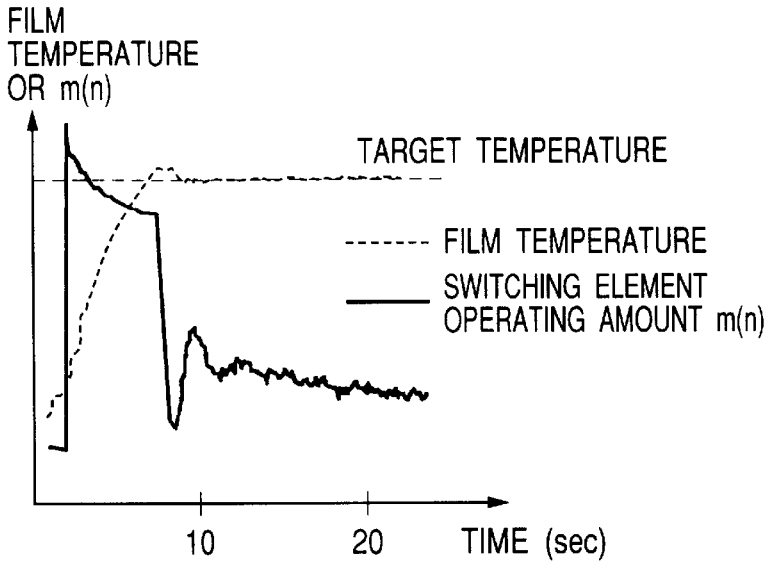
FIGS. 10A, 10B and 10C are views showing the relation of changes of film temperatures and operating amounts m(n) of a switching element when control by a method in the embodiment of FIG. 1 and control by a conventional method are performed.
Figure 10B:
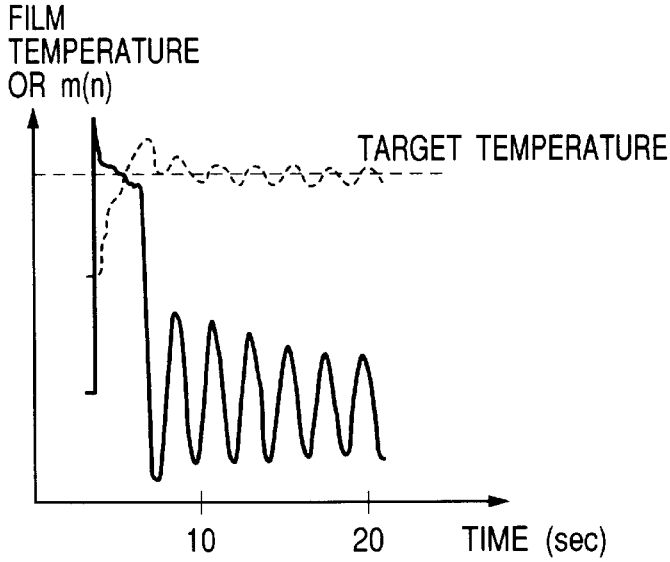
Figure 10C:
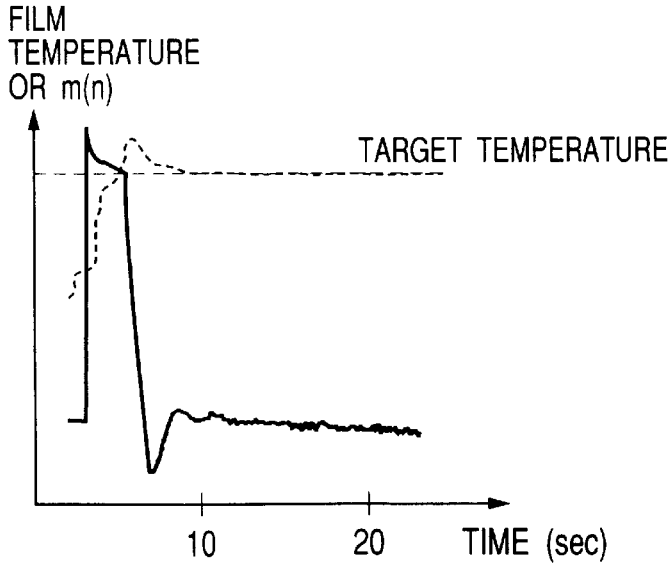

FIGS. 10A to 10C show the relation of changes of the film temperatures and the operating amounts of the switching element when the control by the method in the present embodiment and the control by the conventional method are performed. It should be noted that, in the control by the conventional method, the temperature of the fixing film is controlled with the proportional gain K of the PID control fixed, irrespective of a decrease in the fixing speed. Incidentally, a sampling period of the detected temperature is 20 msec in any case.

FIG. 10A shows the case where the fixing speed is 100 mm/sec, FIG. 10B shows the conventional case where the fixing speed is lowered to 25 mm/sec, and FIG. 10C shows the case in the resent embodiment where the fixing speed is lowered to 25 mm/sec.

As shown in FIG. 10A, when the fixing speed is 100 mm/sec, any vibration does not appear in the operating amount m(n) of the switching element after the film temperature reached the target temperature, in fact the power is appropriately controlled. However, if the fixing speed is lowered to 25 mm/sec without changing the proportional gain K, as shown in FIG. 10B, it is understood that the operating amount m(n) of the switching element vibrates, and also the film temperature does not converge on the target temperature. On the other hand, in the present embodiment, as shown in FIG. 10C, if the fixing speed is lowered to 25 mm/sec, since the proportional gain K is changed, as well as the case where the fixing speed is 100 mm/sec, any vibration does not appear in the operating amount m(n) of the switching element after the film temperature reached the target temperature, whereby it is understood that the supplied power is appropriately controlled.

As described above, in the present embodiment, the deviation of the temperature of the fixing film from the target temperature caused by the disturbance can be controlled to the minimum, whereby the temperature of the fixing film can be maintained at the target temperature in high accuracy. Therefore, unevenness in gloss of the fixed image, unevenness in transparentness of the fixed image on the OHP film, and defective fixing can be prevented.

Embodiment 2

The great feature of the present embodiment is to, in addition to the control of the embodiment 1, set an initial value m(0) of the operating amount of the switching element in the calculation of the PID control to be larger than "0".

As described in the embodiment 1, if it decreases the value of the proportional gain K as the fixing speed decreases, the reaction of the temperature control system for the temperature change due to disturbance or the like becomes slow. For this reason, if the deviation between the target temperature and the fixing film temperature is large and thus the supply of the maximum power is required as in the case of rising the fixing apparatus from the state that the apparatus cooled up to the normal temperature, a time is required to change the operating amount up to the maximum value when beginning to increase the initial value m(0) of the operating amount of the switching element from "0" by the calculation of the PID control. Therefore, the maximum power can not be instantaneously supplied, whereby the fixing apparatus might not rise up to the target temperature within a defined time.

Accordingly, in the present embodiment, the initial value m(0) of the operating amount of the switching element when the power supply starts is set to the value larger than "0". To achieve the quick rise of the film temperature, it is desirable to set the initial value m(0) close to the maximum value as much as possible. However, since there are a load and a noise originating in an extreme power increase, it is desirable to set the initial value m(0) to the value in which the prevention of such the load and the noise is considered. In the present embodiment, the value corresponding to 15 $\mu$sec being the maximum ON time of the switching element is set as the initial value m(0) of the operating amount.

Figure 11:
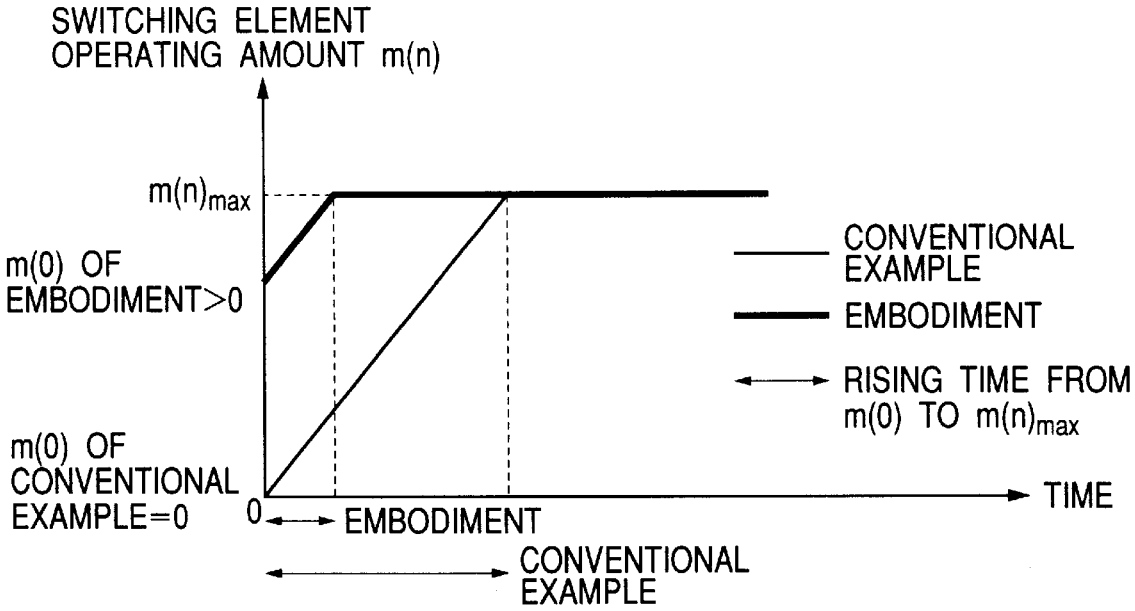
FIG. 11 is a view showing a change of an operating amount m(n) of a switching element in another embodiment of the present invention.

FIG. 11 is a view showing a change of the operating amount m(n) of the switching element when rising the fixing apparatus in a mode of the fixing speed 25 mm/sec. By setting the initial value m(0) to be larger than "0" as in the present embodiment, the rising time from "0" of m(n) to $m(n)_{max}$ can be shortened.

According to the present embodiment, as well as the embodiment 1, the maximum power is instantaneously supplied when starting the control even if the gain of the PID control is made small, the rising of the temperature of the fixing film does not become late.

Embodiment 3

The feature of the present embodiment is to, in addition to the control of the embodiment 1, set the value of the proportional gain in the control rule of the PID control to be large only for the period until the temperature of the fixing film reaches the target temperature from the start of the PID control.

If the deviation between the film temperature at this moment and the target temperature is large as in the case of rising the fixing apparatus from the state that the apparatus cooled at the normal temperature, the supply of the maximum power is instantaneously required. However, as described in the embodiment 1, if it decreases the value of the proportional gain K of the PID control, the reaction of the temperature control system for the temperature change becomes slow. Thus, since a time is required to change the supply of power from "0" to the maximum, the maximum power can not be instantaneously supplied, whereby the fixing apparatus might not rise up to the target temperature within a defined time.

Accordingly, in the present embodiment, the value of the proportional gain K is set to be large only for the period until the temperature of the fixing film first reaches the target temperature from the start of the control. The value of the proportional gain K in the present embodiment is set as shown in Table 2.

TABLE 2

| $V_F$ | K (from control start to target temp. reach) | K (after target temp. reach) |
|---|---|---|
| 100 mm/sec | 4 | 4 |
| 50 mm/sec | 4 | 3 |
| 25 mm/sec | 4 | 2.5 |

Figure 12:
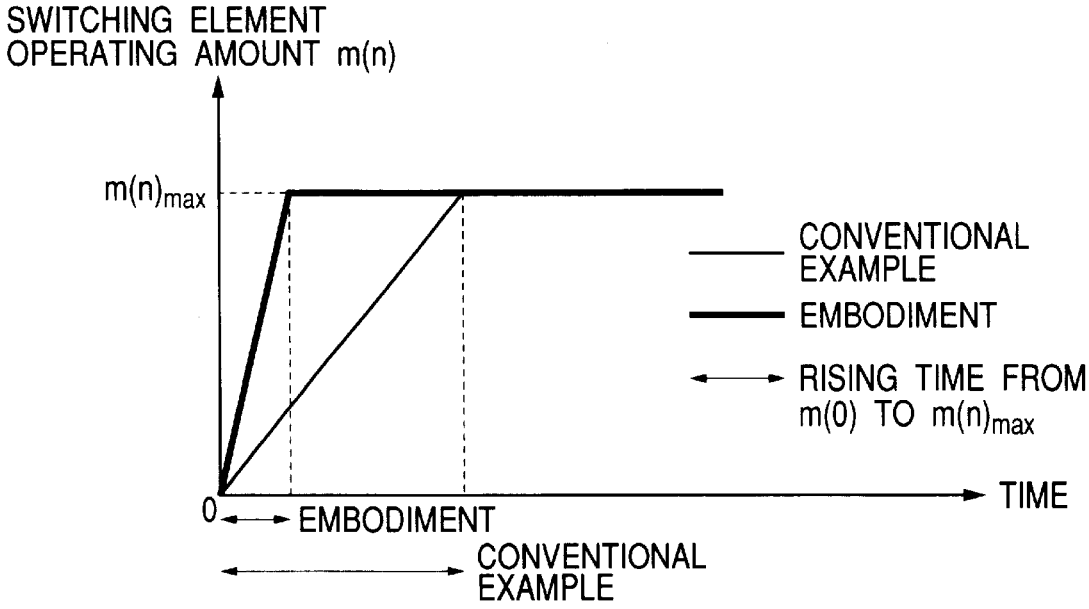
FIG. 12 is a view showing a change of an operating amount m(n) of a switching element in a still another embodiment of the present invention.

FIG. 12 is a view showing a change of the operating amount m(n) of the switching element when rising the fixing apparatus at the fixing speed 25 mm/sec. By setting the proportional gain K only when rising the apparatus as in the present embodiment, the rising time from "0" of m(n) to $m(n)_{max}$ can be shortened.

According to the present embodiment, as well as the embodiment 1, the maximum power is instantaneously supplied when starting the control even if the gain of the PID control is made small, the rising of the temperature of the fixing film does not become late.

Embodiment 4

The feature of the present embodiment is to change a sampling period $T_S$ of the information from the temperature sensor 26 used for the control rule in the PID control, in accordance with the fixing speed.

Figure 13:
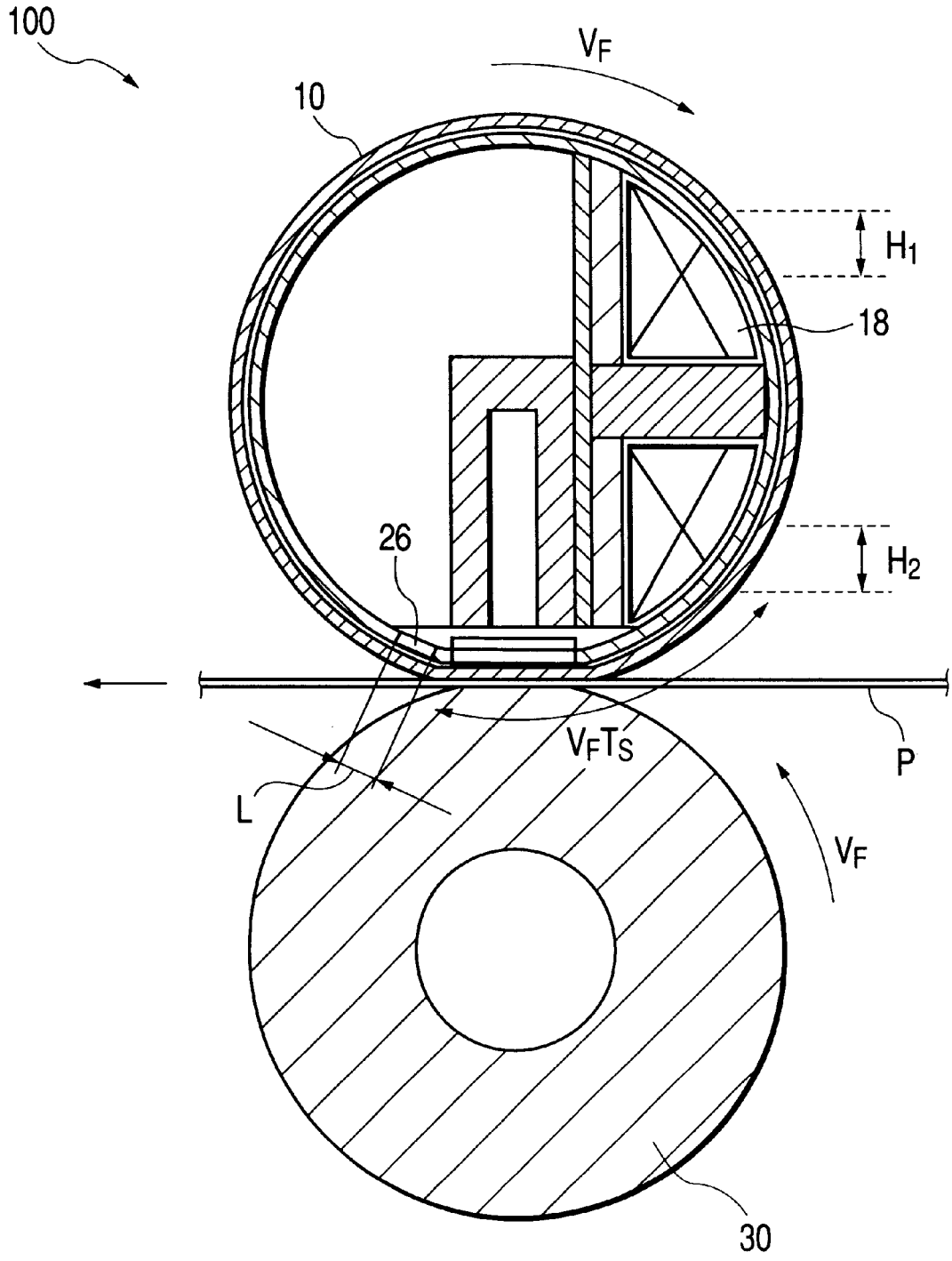
FIG. 13 is a view showing the relation between a heat generating area and a temperature detecting area on a fixing film in a still another embodiment of the present invention.

FIG. 13 shows the relation between heat generating areas $H_1$ and $H_2$ and a temperature detecting area L in the present embodiment. According to the structure of the present embodiment, the heat generating areas $H_1$ and $H_2$ are arranged at the opposing parts of the excitation coil 18, and the temperature detecting area L is arranged at the downstream part of the fixing nip portion N. When the heat generating areas are separated from the temperature detecting area as above, if the fixing speed changes, of course the timing at which a part of the fixing film heated at the heat generating area reaches the temperature detecting area L changes.

For example, a time until the part of the fixing film of which temperature was changed at the heat generating area $H_2$ reaches the temperature detecting area L is assumed to be a sampling time $T_S$, and a driving speed at this time is assumed to be $V_F$. In this case, the distance from the heat generating area $H_2$ to the temperature detecting area L is equivalent to $V_F \cdot T_S$. If the fixing film is driven at the speed $V_F/2$, the part of the fixing film can be moved only by the distance $V_F \cdot T_S/2$ in the time $T_S$ from the heat generating area $H_2$, whereby the part of the film does not reach the temperature detecting area L. In such a state, since the temperature control system can not accurately feed back the control result, the calculated control amount of the switching element vibrates, whereby the vibration is generated as the fixing temperature repeats overshoot and undershoot.

Accordingly, in the present embodiment, the sampling time $T_S$ is changed in accordance with the rotation speed of the fixing film to correct a lag of the sampling timing of the temperature information for the change of the fixing speed. Incidentally, it only has to elongate the sampling time $T_S$ as the fixing speed lowers.

In the present embodiment, the sampling time (period) $T_S$ for each fixing speed is set as follows. When the fixing apparatus is driven at a first fixing speed $V_{F1}$, a sampling time adjusted is assumed to be $T_{S1}$. When the fixing apparatus is driven at a second fixing speed $V_{F2}$, a sampling time adjusted is assumed to be $T_{S2}$. These parameters are set to satisfy the relation indicated by the following equation (7).

$$T_{S2}=T_{S1}\times(V_{F1}/V_{F2} \quad (7)$$

The sampling time $T_S$ for each of the three kinds of fixing speeds $V_F$ in the present embodiment is shown in Table 3.

TABLE 3

| $V_F$ | $T_S$ |
|---|---|
| 100 mm/sec | 20 msec |
| 50 mm/sec | 40 msec |
| 25 mm/sec | 80 msec |

By the above method, even if the fixing speed changes, the optimum PID control can be achieved by changing the sampling time, whereby the temperature of the fixing film can be stabilized in the vicinity of the target temperature. Therefore, also in the present embodiment, unevenness in gloss of the fixed image, defective fixing, and unevenness in transparentness of the fixed image on the OHP film can be prevented.

As above, although the embodiments 1 to 4 were explained as examples of the PID control, the present invention is not limited to this. If the control method is the method of adjusting power supplied to the heat generating means of the fixing apparatus, the similar effect can be achieved by similarly applying such the method. In addition to the image heating apparatus of induction heating system, the present invention is applicable to an image heating apparatus of heat roller system which uses a heater such as a halogen lamp or the like, and an image heating apparatus of film heating system which uses a film moving as coming into contact with a heater such as a ceramic heater or the like.

As explained above, according to the present invention, even if the fixing speed changes, it is possible to prevent the unevenness in gloss of the fixed image, the defective fixing, and the unevenness in transparentness of the fixed image on the OHP film, by stably maintaining the temperature of the heating member such as the fixing film or the like at the target temperature.

It should be noted that the present invention is not limited to the above-described embodiments but includes the various modifications of the same technical concept as that of the present invention.

What is claimed is:

1. An image heating apparatus comprising:

heating means for heating an image formed on a recording material, said heating means including a moving member, which is moving as it comes into contact with the recording material, said moving member capable of moving at a first moving speed and a second moving speed, which is lower than the first moving speed;

a temperature detecting element for detecting a temperature of said heating means; and power supply control means for controlling electrical power supplied to said heating means so that the temperature detected by said temperature detecting element is maintained at a set temperature, wherein said power supply control means controls the electrical power, so that a control amount according to a deviation between the set temperature and a detected temperature at the first moving speed is different from a control amount at the second moving speed.

2. An image heating apparatus according to claim 1, wherein said power supply control means controls the electrical power, so that the control amount according to a deviation between the set temperature and a detected temperature at the first moving speed is larger than the control amount at the second moving speed.

3. An image heating apparatus according to claim 2, wherein said power supply control means sets a proportional gain of a control amount according to the moving speed.

4. An image heating apparatus according to claim 3, wherein the proportional gain at the second moving speed is smaller than the proportional gain at the first moving speed.

5. An image heating apparatus according to claim 3, wherein said power supply control means sets the proportional gain according to the moving speed after said heating means arrives at the set temperature.

6. An image heating apparatus according to claim 3, wherein the proportional gain is larger as the detected temperature rises to the set temperature than the proportional gain after the detected temperature arrives at the set temperature.

7. An image heating apparatus according to claim 2, wherein said power supply control means sets the electrical power by a proportional, integral, and derivative control.

8. An image heating apparatus according to claim 1, wherein said heating means further includes a heater provided inside said moving member, and the electrical power is supplied to said heater.

9. An image heating apparatus according to claim 1, wherein said heating means further includes a heater provided inside and disposed in contact with said moving member and the electrical power is supplied to said heater.

10. An image heating apparatus according to claim 1, wherein said moving member includes a conductive layer, said heating means further includes a coil to generate an eddy current in said conductive layer, and the electrical power is supplied to said coil.

11. An image heating apparatus comprising:

heating means for heating an image formed on a recording material, said heating means including a moving member, which is moving as it comes into contact with the recording material;

a temperature detecting element for detecting a temperature of said heating means; and power supply control means for controlling electrical power to said heating means so that the temperature detected by said temperature detecting element is maintained at a set temperature, wherein said power supply control means sets a sampling period of an output of said temperature detecting element in accordance with a moving speed of said moving member.

12. An image heating apparatus according to claim 11, wherein said moving member can move at a first speed and a second speed lower than the first speed, and the sampling period when said moving member moves at the second speed is longer than the sampling period when said moving member moves at the first speed.

13. An image heating apparatus according to claim 11, wherein said heating means further includes a heater inside said moving member, and the electrical power is supplied to said heater.

14. An image heating apparatus according to claim 11, wherein said heating means further includes a heater being in contact with said moving member inside said moving member, and the electrical power is supplied to said heater.

15. An image heating apparatus according to claim 11, wherein said moving member includes a conductive layer, said heating means further includes a coil to generate an eddy current in said conductive layer, and the electrical power is supplied to said coil.

16. An image forming apparatus comprising:

an image forming unit which is configured to form an image on a recording material;

a fixing unit, which includes a heater for heating an image formed on a recording material, and a moving member, which is moving as its comes into contact with the recording material;

a temperature detecting element for detecting a temperature of said fixing unit; and a power supply controller configured to control electrical power to said heater so that the detected temperature is maintained at a set temperature, wherein said moving member moves at a first moving speed and a second moving speed, which is lower than the first moving speed, and wherein said power supply controller controls the electrical power, so that a control amount according to a deviation between the set temperature and the detected temperature at the first moving speed is different from a control amount at the second moving speed.

17. An image forming apparatus according to claim 16, wherein said power supply controller controls the electrical power, so that the control amount according to a deviation between the set temperature and the detected temperature at the first moving speed is larger than the control amount at the second moving speed.

18. An image forming apparatus according to claim 16, wherein a proportional gain of a control amount at the second moving speed is smaller than the proportional gain at the first moving speed.

19. An image forming apparatus according to claim 18, wherein said power supply controller sets the proportional gain according to the moving speed after the detected temperature arrives at the set temperature.

20. An image forming apparatus according to claim 16, wherein said moving member includes a conductive layer, said heater further includes a coil to generate an eddy current in said conductive layer, and the electrical power is supplied to said coil.

* * * * *

UNITED STATES PATENT AND TRADEMARK OFFICE

CERTIFICATE OF CORRECTION

PATENT NO. : 6,671,470 B2
DATED : December 30, 2003
INVENTOR(S) : Masahiro Suzuki et al.

It is certified that error appears in the above-identified patent and that said Letters Patent is hereby corrected as shown below:

Title page,
Item [57], ABSTRACT,
Line 2, “heating” (second occurrence) should read -- a heating --;
Line 4, “coming” should read -- it comes --; and
Line 6, “power” should read -- a power --.

Column 3,
Line 62, “a” (second occurrence) should be deleted; and
Line 66, “a” should be deleted.

Column 4,
Line 16, “film” should read -- a film --; and
Line 56, “Ti” should read -- T1 --.

Column 5,
Line 18, “speed same” should read -- same speed --;
Line 30, “is, fed” should read -- is fed --; and
Lines 54 and 59, “that” should read -- so that --.

Column 6,
Line 46, “to” should read -- to a --; and
Line 59, “ends” should read -- ends of --.

Column 7,
Line 40, “bunch” should read -- wound --; and
Line 63, “need” should read -- needs --.

Column 9,
Line 43, “as” should read -- and --.

Column 10,
Line 49, “to” should be deleted.

Column 11,
Line 19, “contact” should read -- a contact --; and
Line 33, “tightly” should read -- tightly in contact --.

Column 12,
Line 5, “depth a” should read -- depth $\sigma$ --; and
Line 44, “that” should read -- when --.

UNITED STATES PATENT AND TRADEMARK OFFICE

CERTIFICATE OF CORRECTION

PATENT NO. : 6,671,470 B2
DATED : December 30, 2003
INVENTOR(S) : Masahiro Suzuki et al.

It is certified that error appears in the above-identified patent and that said Letters Patent is hereby corrected as shown below:

Column 13,
Line 8, “unevenness” should read -- uneven --; and
Line 21, “flux, energy.” should read -- flux) energy. --.

Column 14,
Line 19, “KTs/T1·e(n5)” should read -- Kts/TI·e(n) … (5) --.

Column 17,
Line 52, “$T_{S2}=T_{S1}\times(V_{F1}/V_{F2}$” should read -- $T_{S2}=T_{S1}\times(V_{F1}/V_{F2})$ --.

Column 19,
Line 11, “member” should read -- member, --.

Signed and Sealed this

Sixth Day of July, 2004

JON W. DUDAS
*Acting Director of the United States Patent and Trademark Office*